US011655981B1

(12) United States Patent
Cantelar

(10) Patent No.: US 11,655,981 B1
(45) Date of Patent: May 23, 2023

(54) COLLAPSIBLE FIRE PIT

(71) Applicant: Eduardo M Cantelar, Miami, FL (US)

(72) Inventor: Eduardo M Cantelar, Miami, FL (US)

( * ) Notice: Subject to any disclaimer, the term of this patent is extended or adjusted under 35 U.S.C. 154(b) by 0 days.

(21) Appl. No.: 18/161,078

(22) Filed: Jan. 29, 2023

(51) Int. Cl.
*F24B 1/181* (2006.01)
*F24B 1/192* (2006.01)

(52) U.S. Cl.
CPC ..... *F24B 1/181* (2013.01); *F24B 1/192* (2013.01)

(58) Field of Classification Search
CPC ..... F24B 1/181; F24B 1/192; A47J 37/0704; A47J 37/0731
See application file for complete search history.

(56) References Cited

U.S. PATENT DOCUMENTS

RE26,123 E * 12/1966 Davis ..... A47J 37/0704 126/25 R
5,036,832 A * 8/1991 Schlosser ..... A47J 37/0704 D7/334
2004/0000303 A1* 1/2004 Regen ..... A47J 37/0731 126/25 R
2014/0345594 A1* 11/2014 Rhodes ..... A47J 37/0763 126/25 R
2015/0291309 A1* 10/2015 McGregor ..... B65D 21/086 220/573.1
2020/0015626 A1* 1/2020 Corso ..... A47J 37/0704
2021/0276766 A1* 9/2021 Yu ..... B65D 43/065

* cited by examiner

*Primary Examiner* — Alfred Basichas
(74) *Attorney, Agent, or Firm* — Ruben Alcoba, Esq.

(57) ABSTRACT

A collapsible firepit that is easily transportable. The collapsible fire pit is made of a ring base that has a plurality of rings that extend outward and upward from the ring base. The ring base has an outer wall that extends upward from the circumference of the base. The plurality of rings have outer walls that measure at least three inches in height, and each ring has a circumference that is larger than an outer wall in which it is secured on. Each of the plurality of rings is attached to each other via the L-shaped channels and the pins. The pins are inserted within the L-shaped channels and the movement of the pins while in the L-shaped channels direct the position in which the collapsible fire pit will rest. The collapsible fire pit can be in an extended position and in a collapsed position.

10 Claims, 3 Drawing Sheets

COLLAPSIBLE FIRE PIT

TECHNICAL FIELD

The present invention pertains to a collapsible fire pit that is easy to transport.

BACKGROUND

The inventor of the present invention is an avid outdoorsman who loves taking cross country trips in his vehicle.

One of the biggest problems that he has suffered in his trips is having to set up a grill and break up a grill to nourish himself, and then to stow the grill after it use. Usually when stowing the grill, either himself or his vehicle get filthy during the process.

Another problem that he suffers on his road trips is that when he takes a grill, the grill is an unstable structure that tends to fall over in his vehicle.

Yet another problem he experiences when camping is freezing temperatures when he hikes away from his vehicle. Often, he is forced to dig holes in the ground to create fire pits in desolate areas to warm himself.

Because of the above mentioned problems, the inventor conceived the present invention, a lightweight, collapsible fire pit, that could also work as an outdoor cooking grill that is easy to transport.

The present invention is designed, when collapsed, to be easily attachable to a backpack. It is also designed, when it is collapsed, to be placed flat on a vehicle structure.

SUMMARY

The present invention is directed to a collapsible fire pit that is easy to transport.

The collapsible travel pit comprises of a ring base that has a plurality of rings that extend upward from the base. The ring base has a base and an outer wall that extends upward from a circumference of the base, the outer wall measures at least three inches in height. Each of the plurality of rings has an outer wall that measures at least three inches in height, and each ring has a circumference that is larger than an outer wall of the ring or the outer wall of the ring base that it is secured on. At least three pins are defined on the outer wall of the ring base. Each outer wall of each ring of the plurality of rings defines at least three L-shaped channels and at least three pins. Each L-shaped channel receives each pin of the collapsible fire pit. The position of the pins when in the L-shaped channels direct the position in which the collapsible fire pit rests. The collapsible fire pit rests in either an extended or in a collapsed position. A pair of pivots connect a pair of step clamps to the ring base. The pair of pivots are diametrically positioned on the ring base. A cover that removably attaches to the outer wall of an outer ring that has the greatest circumference of the collapsible fire pit. The cover defines at least one T-shaped guide on a cover outer wall, the T-shaped guide receives at least one pin of the outer ring. The cover further defines a centrally positioned handle on a top side of the cover and two diametrically positioned apertures that are configured to receive the pair of step clamps when the collapsible fire pit is collapsed. The ring base further defines a centrally position air flow aperture. And, the collapsible fire pit has an elevated ash pan that is removable attached to the ring base and a screen tray that is placed on the ash pan.

In preferred embodiments of the present invention, the material to fabricate the ring base, the plurality of rings and the cover are made of a rigid fire-resistant material that does not conduct heat.

An object of the present invention is to provide a collapsible travel pit that can easily be stored in a vehicle.

Another object of the present invention is to provide a collapsible fire pit that can be used as an emergency stove.

Yet another object of the present invention is to provide a collapsible fire pit that is easy to stow in a backpack.

Yet still another object of the present invention is to provide a tactical collapsible fire pit that can be used by military personnel when on clandestine missions.

A further object of the present invention is to provide a collapsible fire pit that can be laid flat in a transport vehicle and that will not flip while in transport.

Yet a further object of the present invention is to provide a collapsible fire pit that will prevent animals from getting injured if they inadvertently touch the outer walls of the pit when the pit is burning a combustible material.

Yet still a further object of the present invention is to provide a camper with a fire pit that can easily be transported and stowed after use that will not dirty the transport vehicle.

BRIEF DESCRIPTION OF THE DRAWINGS

These and other features, aspects, and advantages of the present invention will become better understood with regards to the following description, appended claims, and drawings where:

DESCRIPTION

Figure 1:
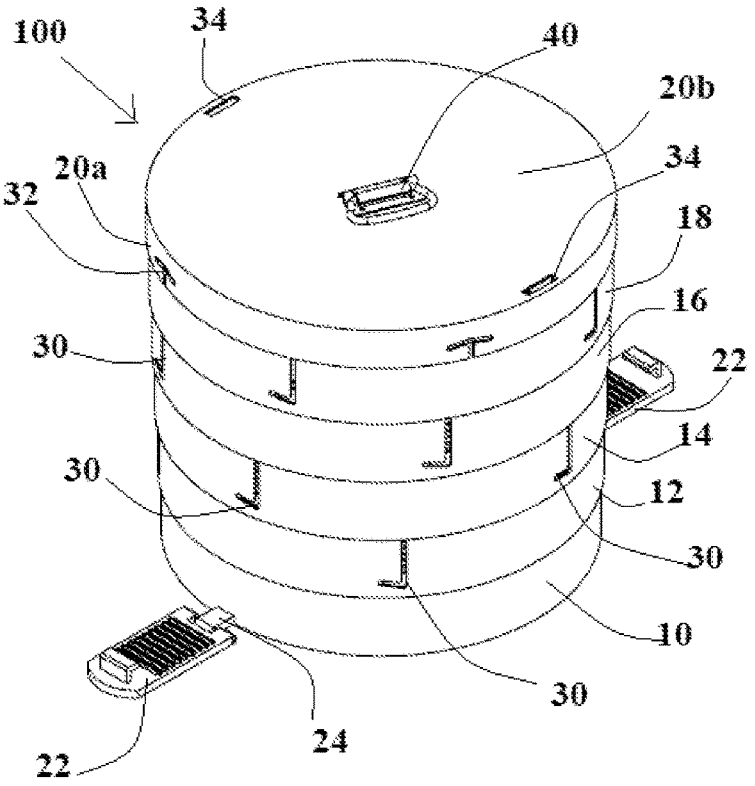
FIG. 1 is a perspective view of the present invention in an expanded position.
Figure 2:
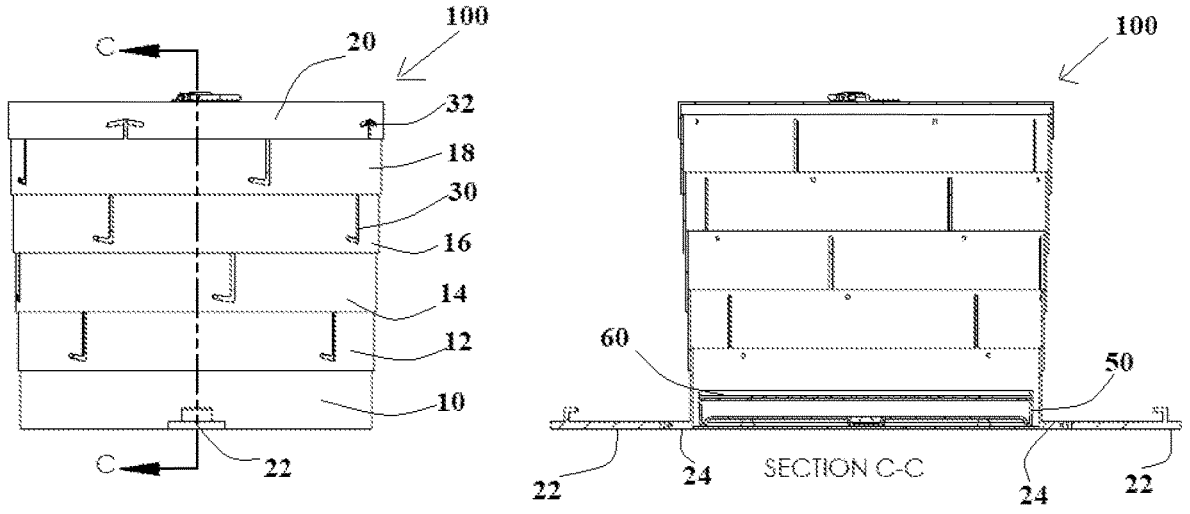
FIG. 2 is a front view of the present invention that further shows a sectional view of the present invention.
Figure 3:
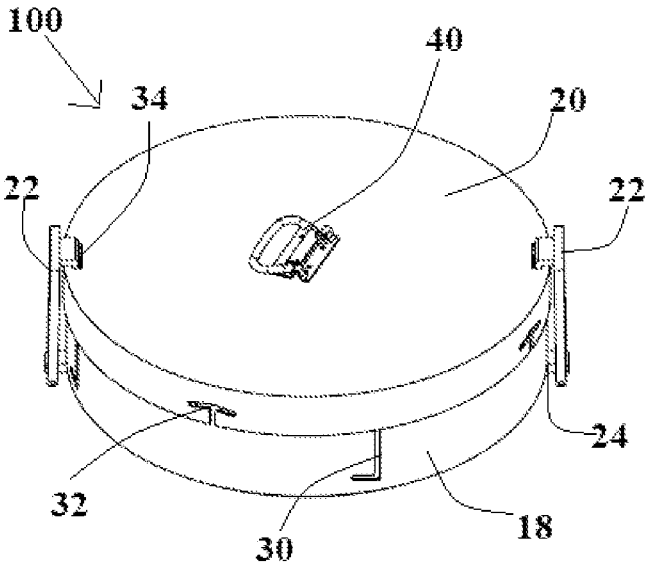
FIG. 3 is a perspective view of the present invention in a collapsed position.
Figure 4:
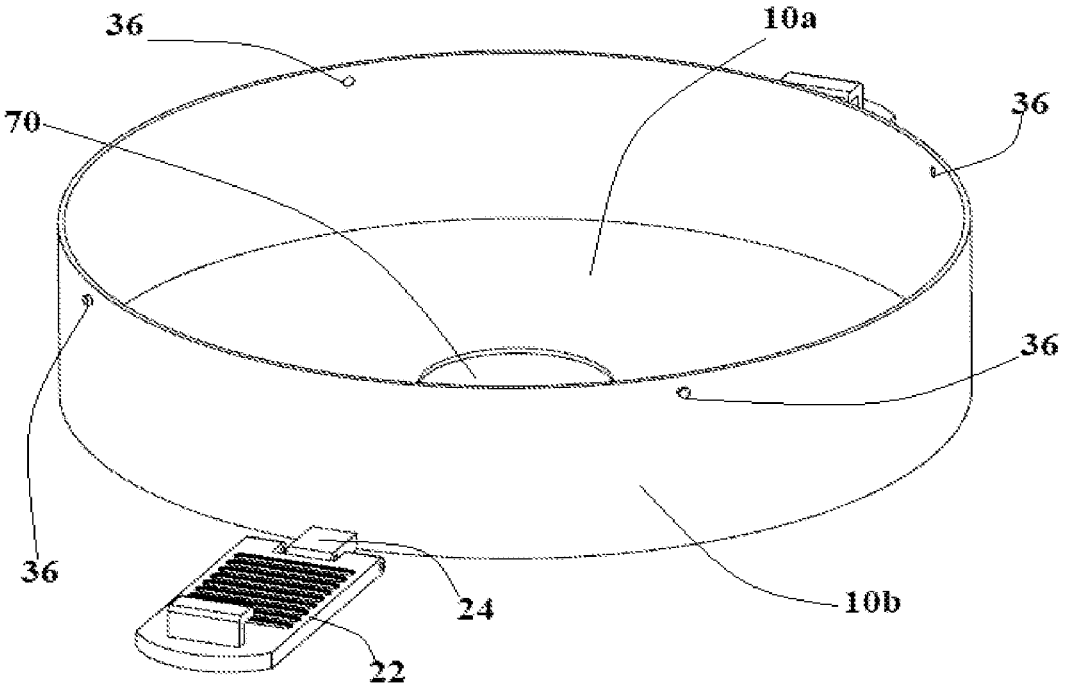
FIG. 4 is a perspective view of the ring base of the present invention.
Figure 5:
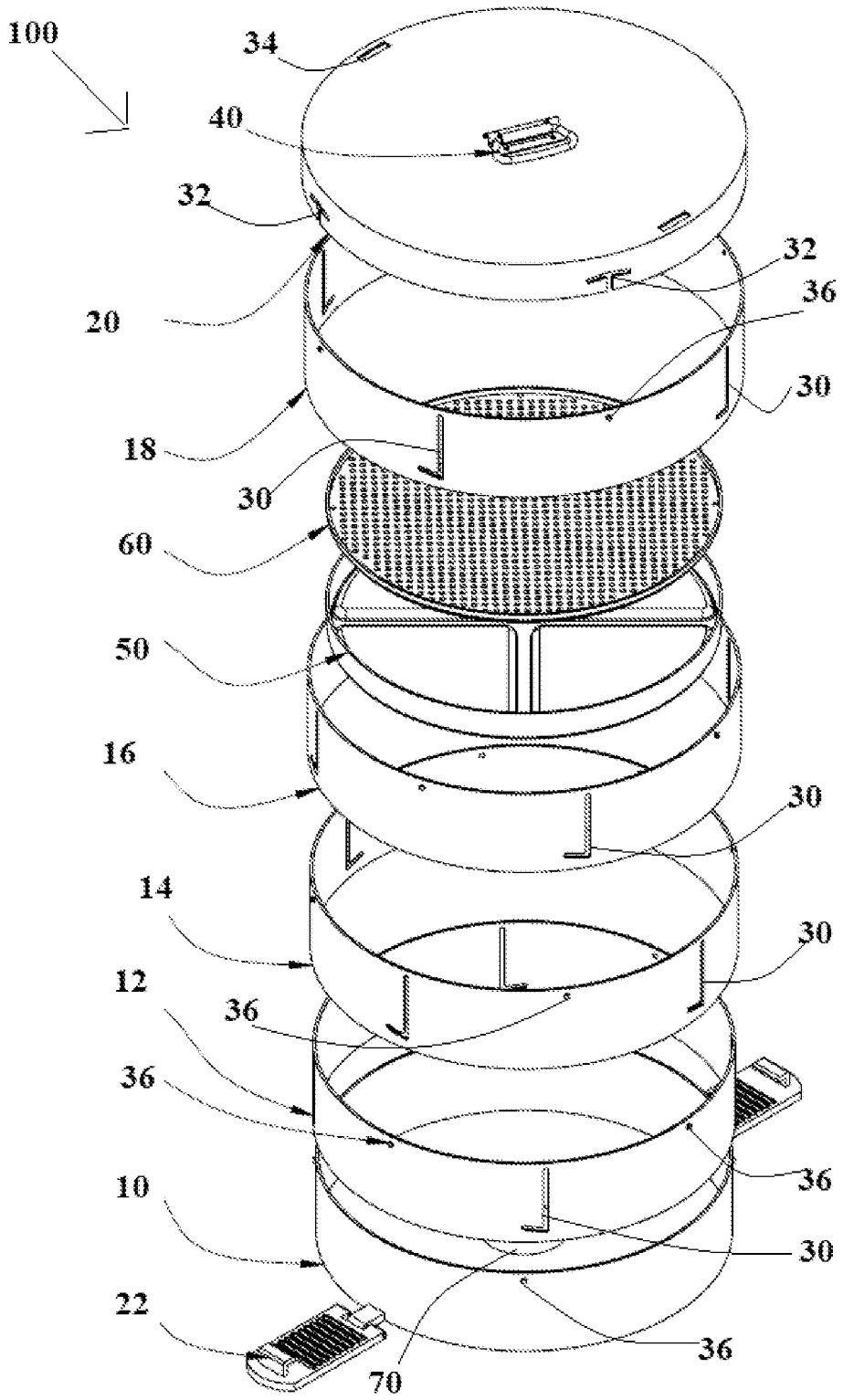
FIG. 5 is an exploded view of the present invention.

As seen in FIGS. 1-5, the present invention is a collapsible fire pit 100 that is easy to transport.

The collapsible fire pit 100 comprises a ring base 10 has a base 10*a* and an outer wall 10*b* that extends upward from a circumference of the ring base 10, the outer wall 10*b* of the ring base 10 measures at least three inches in height, at least three pins 36 are defined on the outer wall 10*b* of the ring base 10. A plurality of rings 12, 14, 16, and 18 that extend upward from the ring base 10, each of the plurality of rings 12, 14, 16, and 18 has an outer wall that measures at least three inches in height, and each ring 12, 14, 16, and 18 has a circumference that is larger than an outer wall of the ring 12, 14, 16 or the outer wall 10*b* of the ring base 10 that it is secured on, the outermost ring of the plurality of rings 12, 14, 16, and 18 is an outer ring 18, each outer wall of each ring of the plurality of rings 12, 14, 16, and 18 defines at least three L-shaped channels 30 and at least three pins 36, and each L-shaped channel 30 receives each pin 36 of the collapsible fire pit 10. A pair of pivots 24 connect a pair of step clamps 22 to the ring base 10, the pair of pivots 24 are diametrically positioned on the ring base 10. And, a cover 20 that removably attaches to the outer wall of the outer ring 18, an outer wall 20*a* of the cover 20 defines at least one T-shaped guide 32, the T-shaped guide 32 is configured to receive at least one pin 36 of the outer ring 18, the cover 20 has a centrally positioned handle 20 on a top side 20*b* of the cover 20.

In an embodiment of the present invention, the cover 20 defines two diametrically positioned apertures 234 that are configured to receive the pair of step clamps 22 when the collapsible fire pit is collapsed 100.

In another embodiment of the present invention, the collapsible fire pit comprises 100 an elevated ash pan 50 that is removably attached to the ring base 10, and a screen tray 60 that is placed on the elevated ash pan 50.

In still another embodiment of the present invention, the ring base 10 further defines a centrally position air flow aperture 70.

In yet still another embodiment of the present invention, the ring base 10, the plurality of rings 12, 14, 16, and 18 and the cover 20 are made of a rigid fireproof material. The rigid fireproof material can either be an aluminum or a metallic material. The rigid fire proof material can also be a silicon dioxide composite.

In a further embodiment of the present invention, the elevated ash pan 50 defines a magnetic element that is configured to attach to the ring base 10.

In a preferred embodiment of the present invention, a diameter of the ring base 10 measures at least nineteen inches, and a total height of the outer walls of the collapsible fire pit 100, when extended, measures at least fourteen inches.

An advantage of the present invention is that it provides a collapsible travel pit that is easily be stored in a vehicle.

Another advantage of the present invention is that it provides a collapsible fire pit that serves as an emergency stove.

Yet another advantage of the present invention is that it provides a collapsible fire pit that stows in a backpack.

Yet still another advantage of the present invention is that it provides a tactical collapsible fire pit that military personnel can use when on clandestine missions.

A further advantage of the present invention is that it provides a collapsible fire pit that lays flat in a transport vehicle and that does not flip while in transport.

Yet a further advantage of the present invention is that it provides a collapsible fire pit that prevents animals from getting injured when they inadvertently touch the outer walls of the pit.

Yet still a further advantage of the present invention is that it allows a camper to have a fire pit that he can easily transport and stow after use that will not soil his transport vehicle.

The embodiments of the collapsible fire pit described herein are exemplary and numerous modifications, combinations, variations, and rearrangements can be readily envisioned to achieve an equivalent result, all of which are intended to be embraced within the scope of the appended claims. Further, nothing in the above-provided discussions of the collapsible fire pit should be construed as limiting the invention to an embodiment or a combination of embodiments. The scope of the invention is defined by the description, drawings, and claims.

What is claimed is:

1. A collapsible fire pit that is easy transport, the collapsible fire pit comprises:

a ring base has a base and an outer wall that extends upward from a circumference of the ring base, the outer wall of the ring base measures at least three inches in height, at least three pins are defined on the outer wall of the ring base;

a plurality of rings that extend upward from the ring base, each of the plurality of rings has an outer wall that measures at least three inches in height, and each ring has a circumference that is larger than an outer wall of the ring or the outer wall of the ring base that it is secured on, the outermost ring of the plurality of rings is an outer ring, each outer wall of each ring of the plurality of rings defines at least three L-shaped channels and at least three pins, and each L-shaped channel receives each pin of the collapsible fire pit;

a pair of pivots connect a pair of step clamps to the ring base, the pair of pivots are diametrically positioned on the ring base; and a cover that removably attaches to the outer wall of the outer ring, an outer wall of the cover defines at least one T-shaped guide, the T-shaped guide is configured to receive at least one pin of the outer ring, the cover has a centrally positioned handle on a top side of the cover.

2. The collapsible fire pit that is easy to transport of claim 1, wherein the elevated ash pan defines a magnetic element that is configured to attach to the ring base.

3. The collapsible fire pit that is easy to transport of claim 1, wherein a diameter of the ring base measures at least nineteen inches, and a total height of the outer walls, when extended, measures at least fourteen inches.

4. The collapsible fire pit that is easy to transport of claim 1, wherein the cover defines two diametrically positioned apertures that are configured to receive the pair of step clamps when the collapsible fire pit is collapsed.

5. The collapsible fire pit that is easy to transport of claim 4, the collapsible fire pit comprises an elevated ash pan that is removably attached to the ring base, and a screen tray that is placed on the elevated ash pan.

6. The collapsible fire pit that is easy to transport of claim 5, wherein the ring base further defines a centrally position air flow aperture.

7. The collapsible fire pit that is easy to transport of claim 6, wherein the ring base, the plurality of rings and the cover are made of a rigid fireproof material.

8. The collapsible fire pit that is easy to transport of claim 7, wherein the rigid fireproof material is either an aluminum or a metallic material.

9. The collapsible fire pit that is easy to transport of claim 7, wherein the rigid material is a silicon dioxide composite.

10. The collapsible fire pit that is easy to transport of claim 7, wherein the diameter of the ring base measures at least nineteen inches and a total height of the outer walls when extended measures at least fourteen inches.

* * * * *